United States Patent [19]

DeLong et al.

[11] 4,126,354

[45] Nov. 21, 1978

[54] BENCH SEATS WITH END ALIGNING AND REINFORCING INSERTS

[75] Inventors: David C. DeLong, Grinnell; William O. Shell, Urbandale, both of Iowa

[73] Assignee: Stadiums Unlimited, Inc., Grinnell, Iowa

[21] Appl. No.: 836,368

[22] Filed: Sep. 26, 1977

Related U.S. Application Data

[63] Continuation-in-part of Ser. No. 664,668, Mar. 8, 1976, Pat. No. 4,054,316, which is a continuation-in-part of Ser. No. 519,601, Oct. 31, 1974, Pat. No. 3,960,405, which is a continuation of Ser. No. 326,600, Jan. 26, 1973, abandoned.

[51] Int. Cl.[2] ..... A47C 11/00

[52] U.S. Cl. ..... 297/248; 52/8; 108/64; 297/249

[58] Field of Search ..... 52/8, 9, 588; 108/64, 108/114; 182/222, 223; 248/235; 297/248, 249

[56] References Cited

U.S. PATENT DOCUMENTS

| | | | |
|---|---|---|---|
| 2,985,924 | 5/1961 | Burke | 52/8 |
| 3,482,874 | 12/1969 | Henebry et al. | 297/248 X |
| 3,554,142 | 1/1971 | Sorenson et al. | 297/248 U X |
| 3,584,916 | 6/1971 | Bayes | 297/249 X R |
| 3,657,854 | 4/1972. | Tipton | 52/8 X R |
| 3,960,405 | 1/1976 | DeLong | 297/248 |
| 4,054,316 | 10/1977 | DeLong | 297/248 |

FOREIGN PATENT DOCUMENTS

| | | | |
|---|---|---|---|
| 536,347 | 5/1941 | United Kingdom | 182/222 |
| 656,901 | 9/1951 | United Kingdom | 182/223 |

*Primary Examiner*—James C. Mitchell

*Attorney, Agent, or Firm*—Warren H. Kintzinger

[57] ABSTRACT

An alignment structure for end-to-end positioned multi-channeled seats and footboards such as may be used for seating stadium stands. I-beam shaped inserts positioned in front and rear channels of two end-to-end seat sections (or footboards), and conforming with channel shape, span the joint between the seat sections and extend endwise into each to maintain end-to-end alignment between the seat sections. Each insert is anchored in one or the other of the end-to-end seat sections and permits expansion and contraction displacement movement between the seat sections.

24 Claims, 14 Drawing Figures

BENCH SEATS WITH END ALIGNING AND REINFORCING INSERTS

Figure 1:
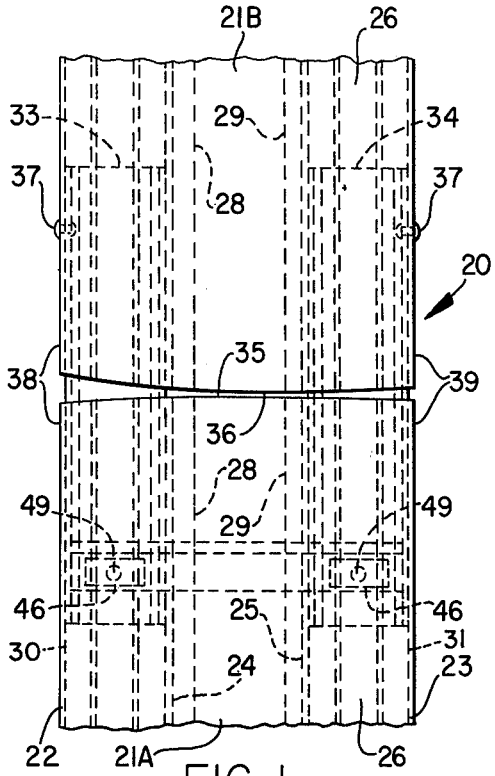

This application is a Continuation-in-part of co-pending application Ser. No. 664,668, filed March 8, 1976, now Pat. No. 4,054,316; the latter a continuation-in-part of application Ser. No. 519,601, filed Oct. 31, 1974, now U.S. Pat. No. 3,960,405; the latter a continuation of application Ser. No. 326,600, filed Jan. 26, 1973 and now abandoned.

This invention relates in general to stadium type seating section-to-section endwise alignment and, in particular, to a front and rear channel insert alignment system for end-to-end positioned seat sections.

It is important that end-to-end positioned elongate channeled stadium seats and footboards be joined together with a relatively smooth joint and remain in line year after year. Alignment should be maintained through seams in continuous row lengths, and expansion joints should be provided to insure alignment throughout expansion and contraction cycles brought on by heating and cooling. Misalignment at a seam has been a constant problem with pre-existing inadequate methods of securing two end-to-end positioned seat sections together over a seat support with a seam plate. This type of structure not only adds expense of bolts required to bolt it together and to the seat support, but also raises up the seat by the gauge thickness of the adapter seam plate to add to the misalignment problem. Further, when a seam plate is used other than over a seat support, as in the middle of a span between two seat supports, strength through the seam joint may be inadequate, marginal at best, and the alignment problem may still exist. When a customer calls for immediate delivery of aluminum plank for stadium seats in a length not stocked, the option heretofore was to either cut down longer lengths, thus producing undesired scrap, or ordering the exact piece count and cutting lengths from an extrusion producer, the latter option involving a procurement procedure generally involving a minimum of six weeks before shipment is made. Continuity in row length, where seating row lengths are curved to conform to the concrete curve at the risers, is desirable, however, there have been problems with miters used and excessive labor costs. Sharp edges at a joint seam of some seating plank units come into contact with either clothes or skin and can easily cut or tear material or skin. This is a hazard with misalignment at seams, particularly with the seam plate method of securing two seat planks together over a seat support, and with plank ends being separated either fore or aft. When butting two aluminum seating planks together the seam will be a perfect seam only if the plank extrusion supplier gives a perfect 90° cut on mating ends, a condition many times not achieved. End capping of seating planks ends and leaving, for example, a half-inch gap spacing is one method that has been used with adjacent seating plank ends, obviously an expensive solution that still does not attain desired alignment and structural integrity.

It is, therefore, a principle object of this invention to attain improved alignment between end-to-end positioned seat and footboard extrusions.

Another object is to provide a safer and stronger stadium seat structure.

A further object is to cut material and labor costs in providing such improved seats.

Another object is more efficient use of stocked seating extrusions with minimized scrap.

Still another object is to achieve more prompt service on custom fabrication jobs through use of a dual channel insert alignment system for end-to-end positioned seat sections.

Another object is to eliminate any requirement for seat plank end miters with curved seat sections.

Still another object is for ease assembly with inserts being inserted into front and rear channels in end-to-end positioned seating extrusions than would be the case with a single channel insert being positioned into and spanning end-to-end seating planks.

A further object is to limit the requirement for plank end caps solely to seating row ends.

Features of this invention useful in accomplishing the above objects include, in a front and rear channel insert alignment system for end-to-end positioned multichanneled seating extrusions, seat extrusions with paralleled front and rear generally "U"-channels. Relatively stiff elongate strong l-beam insert elements, usually of the same material as the seat extrusions, and respectively sized to fit the front and rear "U"-shaped channels of the seat extrusions, are inserted into the appropriate channels of two end-to-end positioned seat extrusions to bridge any gap at the end-to-end seam therebetween and structurally maintain good alignment between the seat extrusions. There is adequate overlap insertion into each respective seat extrusion channel to insure structural integrity, and each of the inserts is fixed in longitudinal position in one or the other of the end-to-end seat extrusions by a rivet or bolt extended through a channel wall of a seat extrusion and through a flange or the insert, so that the expansion and contraction movement in the structure is accommodated with endwise slippage of the insert in at least one of two aligned seat extrusion channels.

Specific embodiments representing what are presently regarded as the best modes of carrying out the invention are illustrated in the accompanying drawing.

Figure 5:
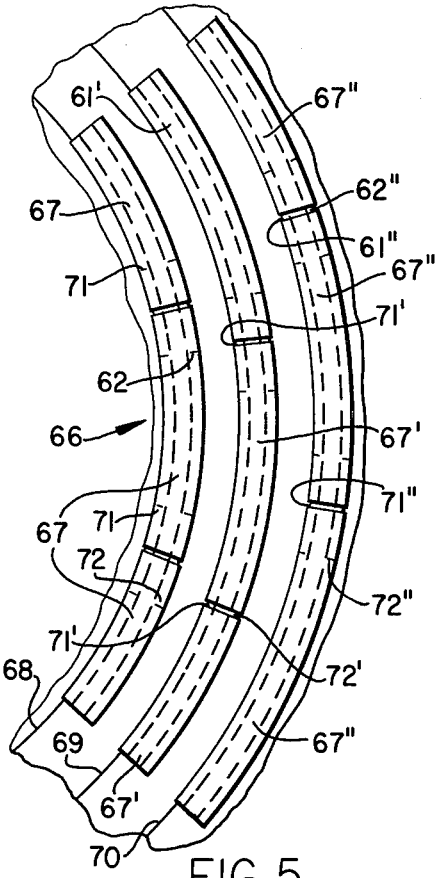
Figure 2:
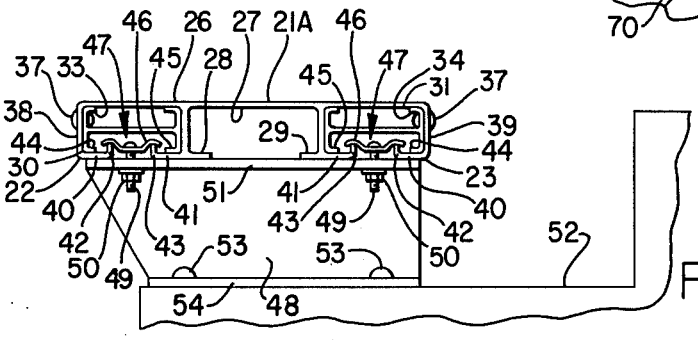
Figure 3:
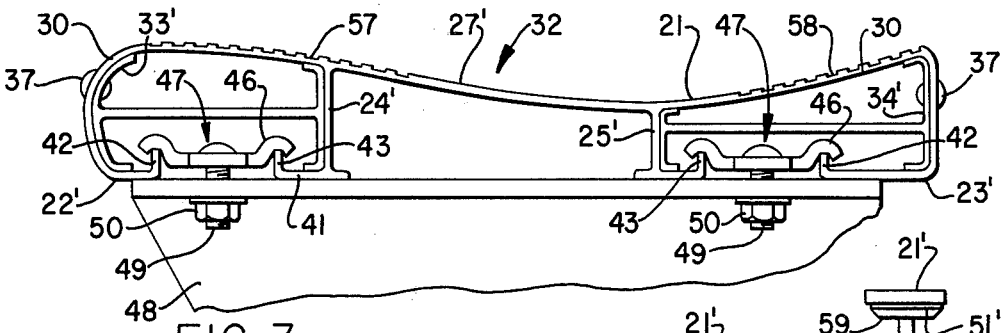
Figure 4:
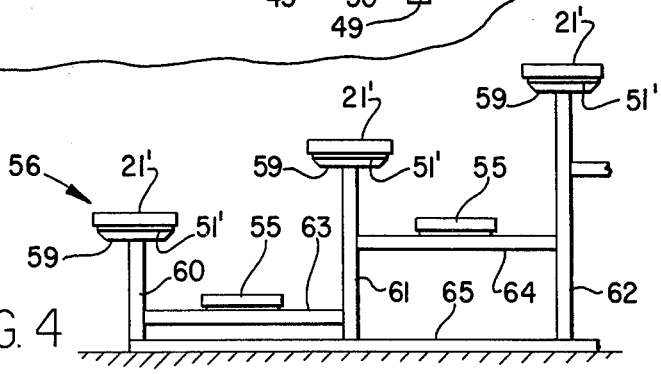
Figure 6:
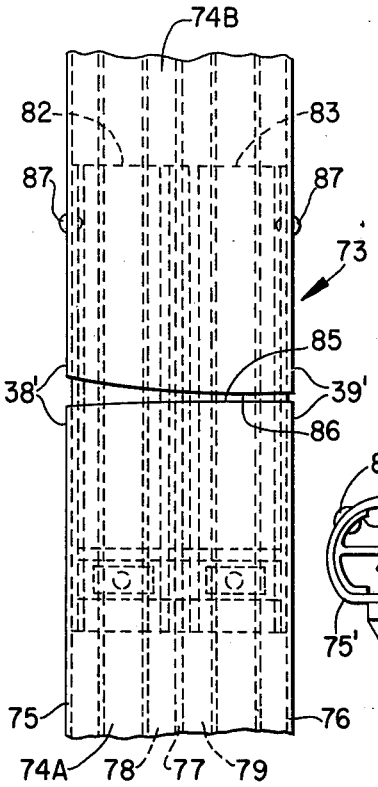
Figure 7:
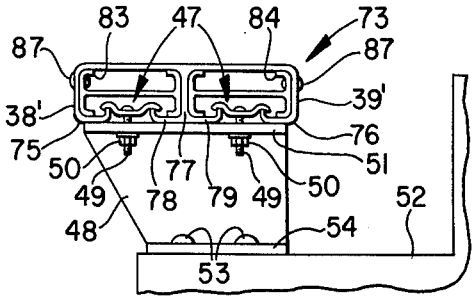
Figure 8:
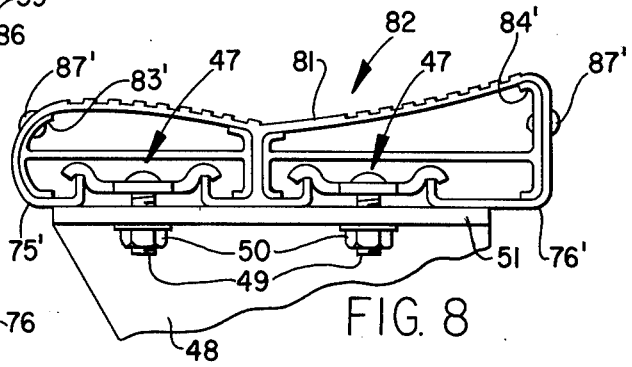
Figure 10:
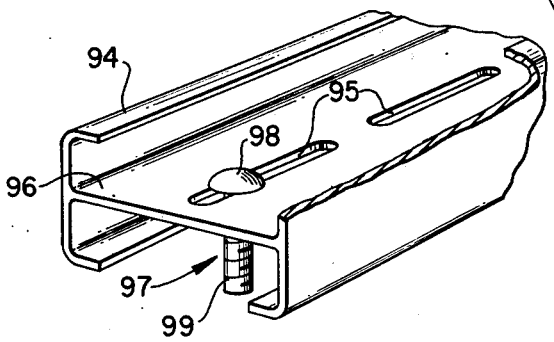
Figure 9:
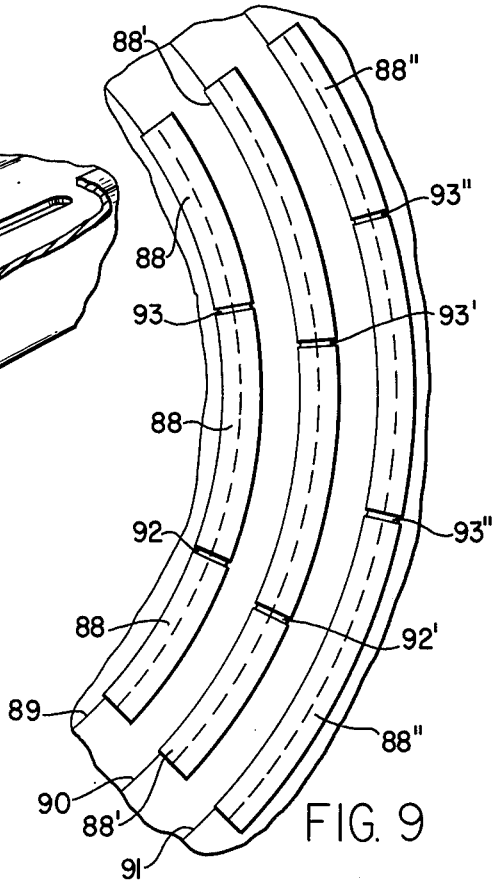
Figure 11:
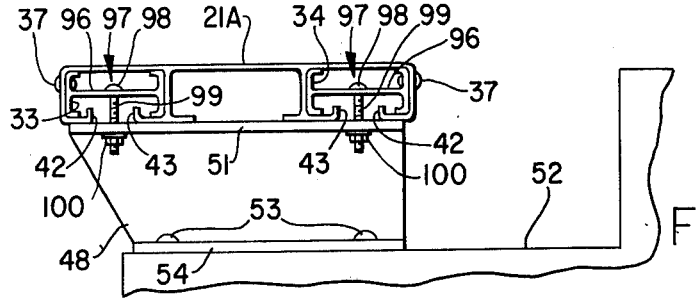
Figure 12:
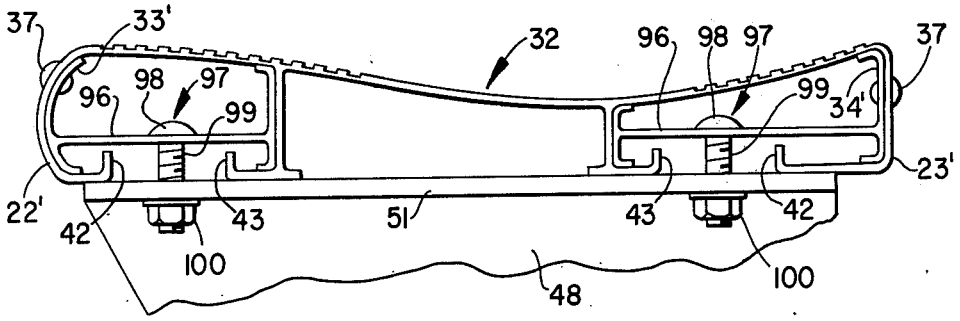
Figure 13:
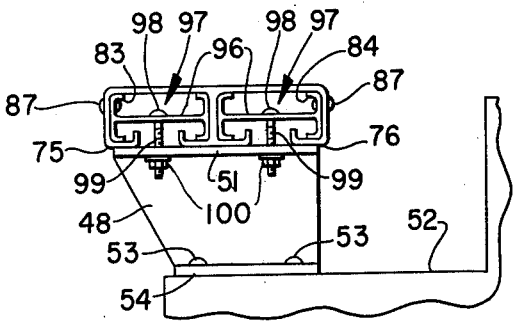
Figure 14:
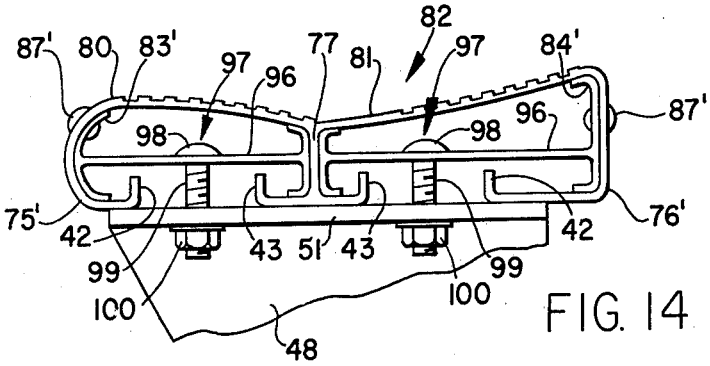

In the drawing:

FIG. 1 represents a partial top plan view of two end-to-end positioned seating plank extrusions having spaced front and rear channels and a front insert and a rear insert in the channels and spanning the extrusion plank end-to-end seam;

FIG. 2, a partial side elevation of the seating plank extrusion assembly of FIG. 1 mounted on a concrete step section of a stadium;

FIG. 3, a partial side elevation of an anatomic contour seating plank embodiment used in place of the seating plank extrusions of FIGS. 1 and 2;

FIG. 4, a partial side elevation of a bleacher using seating planks such as those of FIGS. 1 and 2 that are also used as footboards;

FIG. 5, a partial top plan view of a curved stadium seat section using seating planks such as those of FIGS. 1 and 2 in curved form to match the curve of stadium sections within which they are used;

FIG. 6, a partial top plan view of two end-to-end positioned seating plank extrusions having adjacent front and rear channels and a front insert in the channels and spanning the extrusion plank end-to-end seam;

FIG. 7, a partial side elevation of the seating plank extrusion assembly of FIG. 6 mounted on a concrete step section of a stadium;

FIG. 8, a partial side elevation of an anatomic contour seating plank embodiment used in place of the seating plank extrusions of FIGS. 6 and 7;

FIG. 9, a partial top plan view of a curved stadium seat section using seating planks such as those of FIGS. 6 and 7 in curved form to match the curve of the stadium sections they are used in;

FIG. 10, a partial cut-away perspective view of an l-beam shaped insert with alternate bolt-slot mounting means;

FIG. 11, a partial side elevation of the seating plank assembly of FIG. 2, with the alternate bolt-slot mounting means of FIG. 10;

FIG. 12, a partial side elevation of the seating plank assembly of FIG. 3, with the alternate bolt-slot mounting means of FIG. 10;

FIG. 13, a partial side elevation of the sealing plank assembly of FIG. 7, with the alternate bolt-slot mounting means of FIG. 10; and FIG. 14, a partial side elevation of the seating plank assembly of FIG. 8, with the alternate bolt-slot mounting means of FIG. 10.

Referring to the drawing:

The seating plank extrusion assembly 20 of FIGS. 1 and 2 is shown to include two extruded seating planks 21A and 21B formed with spaced parallel front and rear underside channels 22 and 23. The inner walls 24 and 25 of channels 22 and 23 and the center section of the upper surface portion 26 of plank extrusions 21A and 21B form a center channel 27 open toward the bottom with longitudinal bottom lips 28 and 29. Front and rear underside channels 22 and 23 are essentially duplicates one of the other with the embodiment of FIGS. 1 and 2 while they may be individually shaped spaced front and rear underside channels 30 and 31 as with the seating plank 32 embodiment of FIG. 3. In any event front and rear channel inserts 33 and 34 that are l-beam shaped elements are positioned in channels 22 and 23. The inserts 33 and 34, sized to be snug sliding fits within the channels 22 and 23, are positioned to span the seam between ends 35 and 36 of end-to-end positioned seating planks 21A and 21B and extend sufficiently far into both to maintain excellent alignment therebetween and give structural strength through the joint. Rivets 37 (or bolt structures) are inserted, respectively, through front and rear outer walls 38 and 39 of one or the other of the end-to-end seating planks, and the respective adjacent flanges of the l-beam inserts 33 and 34, such that each insert is secured by a rivet 37 in but one of the two seating plank channels into which it is received.

Each of the front and rear underside channels 22 and 23 has bottom outer and inner lips or webs 40 and 41 with upturned edge extensions 42 and 43 spaced inwardly from the inturned lips 44 and 45 of front and rear l-beam inserts 33 and 34. Clips 46, shaped to fit over the tops of the edge extensions 42 and 43 and span the space therebetween, are used as part of bolt-clip assemblies 47 used for securing seating planks 21A and 21B in place on seat supports 48. Bolts 49 of bolt-clip assemblies 47 extend to nuts 50 through the clips 46 and top flange 51 of seat supports 48 that are in turn mounted in place on a base 52 by mounting pins, bolts or rivets 53 extended through bottom flange 54 of seat supports 48. This is with base 52 a step molded concrete structure such as used in stadiums. It is of interest to note that bolt-clip assemblies 47 may be used with a seat support 48 substantially anywhere longitudinally along the end-to-end positioned seating plank 21A and 21B assembly with inserts 33 and 34 in the area of the inserts or not as desired without the inserts presenting any problems to such mounting. Bolt-clip assemblies 47 may even be used at, for example, the seam at seating plank ends 35 and 36 which are shown with an exaggerated irregular gap in FIG. 1 for illustrative purposes. The l-beam inserts 33 and 34 are positioned very advantageously for the purposes intended giving desired alignment and structural support at the front and back channels of multi-channeled seating planks 21A and 21B. Seating planks 21A and 21B now being supplied are extruded aluminum planks anodized when used as seats 21' and generally non-anodized when used as footboards 55 in the bleacher unit 56 of FIG. 4. l-beam inserts 33 and 34 are much more easily fitted and assembled in place spanning seating plank ends than would be the case with a single large l-beam insert spanning the full width of seating planks from front to rear. Further, such full width seating plank inserts besides being quite awkward to handle and insert would require use of seating planks without internal reinforcing ribs defining a plurality of channels as with the seating planks shown.

The l-beam inserts 33 and 34 as used in the assembly of FIGS. 1 and 2 advantageously facilitates use of random seating plank lengths and reduces scrap to an absolute minimum. The system of inserts permits more prompt service on custom field jobs since the requirements can be filled with any lengths and most cutting sections can be utilized instead of scrapped. Obviously, this leads to optimization of inventory with more stocking of standard length planks and resultant savings to both the supplier and to the customer. The insert seat plank assembly does not require that joints occur at seat supports with the inserts securing and maintaining alignment without requiring critical adjustments and with the inserts extended through joints acting as expansion joints for seat plank expansion and contraction with temperature variation.

Seating plank extrusions with multi-channels open to the bottom can assume any number of configurations other than the straight planks 21A and 21B of FIGS. 1 and 2. The anatomic contour seat plank extrusion 32 of FIG. 3 is only one example of these additional embodiments. With the seating plank extrusion 32 the front and rear underside channels 22' and 23' separated by center channel 27' are of materially different shapes rather than being of substantially the same cross-section as with channels 22 and 23 of FIG. 2 and as a result the front and rear channel inserts 33' and 34' are individually shaped to be snug sliding fits within channels 22' and 23'. Portions of this embodiment substantially the same as with that of FIGS. 1 and 2 are numbered the same and some that are somewhat different are given primed numbers, and a complete explanation thereof is not repeated again as a matter of convenience. The extruded seating plank extrusion 32 is provided with external top surface fluted sections 57 and 58. The positioning of sleeve anchoring rivets 37 extending through insert flanges and channel walls illustrates the flexibility of such sleeve anchoring approach even for the inserts 33 and 34 of FIGS. 1 and 2.

Referring again to the bleacher assembly 56 of FIG. 4 the seats 21' may be end-to-end seating plank 21A and 21B assemblies with inserts 33 and 34 of FIGS. 1 and 2 or the multi-channeled seat plank extrusion 32 of FIG. 3 mounted on a flange 51' of bleacher mounts 59 at the tops of vertical supports 60, 61 and 62, etc. The plank assembly extrusion 21A and 21B assemblies of FIGS. 1 and 2 may also be used as footboards 55 mounted on horizontal frame members 63 and 64, etc. of the bleacher assembly having a base 65 resting on a supporting surface.

The curved stadium seat section 66 of FIG. 5 utilizes an extruded seating plank extrusion such as seat planks 21A and 21B of FIGS. 1 and 2 or seat plank 32 of FIG. 3 or other multi-channeled seating plank extrusions. However, the seating plank extrusions 67, 67', and 67'',etc. used are formed with curves matching curvature of the seat steps 68, 69 and 70, etc. of the supporting structure in the stadium seat section 66. With this structure the inserts 71 and 72, 71' and 72', and 71'' and 72'' used are provided with matching curves respectively to the curvature of the seating extrusions where used. Inserts 71–72'' for spaced front and rear seating plank channels are much more readily formed with a seat plank matching curve and more easily inserted in place than would be the case with one large insert spanning the internal front to rear width of seating planks.

In the embodiment of FIGS. 6–8, the seating plank extrusion assembly 73 of FIGS. 6 and 7 is shown to include two extruded seating planks 74A and 74B formed with adjacent parallel front and rear underside channels 75 and 76. A common inner wall 77 of channels 75 and 76 has longitudinally extending and opposite directed bottom lips 78 and 79. Front and rear underside channels 75 and 76 are essentially duplicates of the other in the embodiment of FIGS. 6 and 7, and may be individually shaped front and rear underside channels 80 and 81 as with the seating plank 82 embodiment of FIG. 8. Front and rear l-beam inserts 83 and 84 are positioned in channels 75 and 76. Inserts 83 and 84 are sized to be snug sliding fits within the channels 75 and 76 and are positioned to span the seam between ends 85 and 86 of end-to-end positioned seating planks 74A and 74B. Rivets 87 (or bolt structures) are inserted respectfully, through front and rear outer walls 38' and 39' of one or the other of the end-to-end seating planks, and the respective adjacent flanges of l-beam inserts 83 and 84, with each l-beam insert being secured by a rivet 87 in but one of the two seating plank channels into which it is received.

Each of the front and rear channels 75 and 76 has bottom outer lips or webs with upturned edge extensions as in the previously described embodiment of FIGS. 1–3 and like bolt-clip assemblies engaging the upturned edge extensions to mount the seat plank assembly in place, and need not be again described as concerns the embodiment of FIGS. 6–8.

FIG. 9 illustrates a curved stadium section employing seat planks 74A and 74B of FIGS. 6 and 7 or seat plank 82 of FIG. 8. As in the embodiment of FIGS. 1–5, seat plank extrusions 88, 88' and 88'' of FIG. 9 are formed with curves matching curvature of seat steps 89, 90, 91, etc., of the supporting structure in the stadium section. l-beam inserts 92 and 93, 92' and 93', 92'' and 93'' are formed with curves matching curvature of the seat steps.

An alternate mounting arrangement for the previously described embodiments is depicted in FIGS. 10–14. FIG. 10 shows a typical l-beam insert 94 formed with longitudinally extending means 95 in the central web 96. A bolt member 97 is extended through the slot 95 such that bolt head 98 rides on the upper surface web 96, with the bolt shank 99 slidingly confined in the slot means 95.

FIG. 11 depicts the alternative mounting arrangement as concerns the embodiment of FIG. 2. Rather than the previously described bolt and clip assemblies 47 which engaged the channel upturned edges 42 and 43 of front channel 22 and rear channel 23, bolt member 97 extends through slot 95 in the web 96 of each insert and through top flange 51 to be secured by nut 100, and thereby clamp the assembly to the top flange 51. With inserts 33 and 34 fastened by rivets 37 in but one of two adjacent seat plank channels, sliding motion between inserts and channels is permitted to accommodate expansion and contraction.

In FIG. 12, the alternative mounting is depicted in conjunction with the embodiment of FIG. 3. Here l-beam inserts 33' and 34' are formed with longitudinally extending through-slots, as per FIG. 10 to receive shanks 99 or mounting bolts 97, with the bolt heads 98 bearing on the upper surfaces of the l-beam control webs 96.

In FIG. 13, the alternative mounting is depicted in conjunction with the embodiment of FIG. 7, with l-beam inserts 83 and 84 formed with longitudinally extending through-slots, as per FIG. 10, to slidingly receive the shanks 99 of bolts 97.

Similarly, in FIG. 14, the alternative mounting for the embodiment of FIG. 8 is shown, with l-beam inserts 83' and 84' formed with longitudinally extending through-slots as per FIG. 10, to receive the shanks 99 of bolts 97, with bolt heads 98 bearing on the upper surfaces of the insert central webs 96.

Whereas this invention is herein illustrated and described with respect to several specific embodiments hereof, it should be realized that various changes may be made without departing from the essential contribution to the art made by the teachings hereof.

We claim:

1. Mass seating equipment comprising end-to-end positioned, multi-channeled, elongate support planks with a support surface; a front channel and a rear channel in each of said elongate support planks; inserts sized to be snug sliding fits in the respective front and rear channels; anchor means for each of said inserts in an insert-receiving channel of one of each end-to-end pair of said support planks; said front and rear channels being spaced apart with a further channel means included in said elongate support planks between the front and rear channels, said further channel means being partially open to the bottom; said front and rear channels of said elongate support planks being partially open to the bottom between web lips extended from channel side walls; said inserts being l-beam shaped having a central web extending between end flanges, with said end flanges being formed with inwardly-turned end extremes in sliding and conforming engagement with side extreme portions of the top and bottom walls of said support plank channels and with said inwardly turned flange end extremes being space separated by a distance greater than that between said support plank channel web lips; said inserts being of adequate length to extend into end-to-end positioned channels of said elongate support planks, with overlap in each giving structural alignment and mutual support to end-to-end positioned ones of said support planks; and mount means, said mount means comprising fastener means engaging only one of said l-beam insert and channel web lips to the exclusion of the other to permit sliding adjustment between said inserts and said support plank channels; with said end-to-end positioned support planks mounted both as seat benches and as footboards; and with said end-to-end positioned planks positioned with an expansion gap between plank ends.

2. The mass seating equipment of claim 1, with said fastening means engaging said channel web lips, said fastening means comprising bolt-clip assemblies and fixed mounting flanges, said bolt-clip assemblies engaging said web lips in a clamping action to said fixed mounting flanges through areas of channel insert overlap and through areas outside of channel insert overlap without bolt-clip assembly interference with said inserts.

3. The mass seating equipment of claim 2, wherein said anchor means for each of said inserts comprises a pin element extended through both an elongate support plank channel wall and an end flange of said insert.

4. The mass seating equipment of claim 2, wherein said front and rear inserts are of substantially the same shape in transverse cross-section.

5. The mass seating equipment of claim 2, wherein said front and rear inserts are individually shaped to match front and rear channels of different shape in a contoured support plank extrusion mounted for seating.

6. The mass seating equipment of claim 2, wherein said end-to-end positioned support planks are formed with curves to match the curvature of a stadium section where used; and said front and rear inserts are formed with curves to match the channels where used.

7. The mass seating equipment of claim 1, with said fastening means engaging said l-beam inserts; said fastening means comprising a bolt member the shank of which is passed through the l-beam insert central web at a point intermediate said channel web lips.

8. The mass seating equipment of claim 7, with said l-beam insert central web being formed with elongated longitudinally extending through-slot means through which said bolt member shank extends in sliding confinement.

9. The mass seating equipment of claim 8, wherein said anchor means for each of said inserts comprises a pin element extended through both an elongate support plank channel wall and an end flange of said insert.

10. The mass seating equipment of claim 8, wherein said front and rear inserts are of substantially the same shape in transverse cross-section.

11. The mass seating equipment of claim 8, wherein said front and rear inserts are individually shaped to match front and rear channels of different shape in a contoured support plank extrusion mounted for seating.

12. The mass seating equipment of claim 8, wherein said end-to-end positioned support planks are formed with curves to match curvature of a stadium section where used; and said front and rear inserts are formed with curves to match the channels where used.

13. Mass seating equipment comprising end-to-end positioned, multi-channeled, elongate support planks with a support surface; a front channel and a rear channel in each of said elongate support planks, said front and rear channels having a common inner wall; inserts sized to be snug sliding fits inserted in the respective front and rear channels; anchor means for each of said inserts anchoring said inserts in an insert-receiving channel of one of each end-to-end pair of said support planks; said front and rear channels of said elongate support planks being partially open to the bottom between web lips extended from channel side walls; said inserts being l-beam shaped having a central web extending between end flanges, with said end flanges being formed with inwardly-turned and extremes in sliding and conforming engagement with side extreme portions of the top and bottom walls of said support plank channels and with said inwardly-turned flange end extremes being space separated by a distance greater than that between said support plank channel web lips; said inserts being of adequate length to extend into end-to-end positioned channels of said elongate support planks, with overlap in each giving structural alignment and mutual support to end-to-end positioned ones of said support planks; and mount means, said mount means comprising fastener means engaging only one of said l-beam insert and channel web lips to the exclusion of the other to permit sliding adjustment between said inserts and said support plank channels; with said end-to-end positioned support planks mountable both as seat benches and as footboards; and with said end-to-end positioned planks positioned with an expansion gap between plank ends.

14. The mass seating equipment of claim 13, with said fastening means engaging said channel web lips; said fastening means comprising bolt-clip assemblies and fixed mounting flanges, said bolt-clip assemblies engaging said web lips in a clamping action to said fixed mounting flanges through areas of channel insert overlap and through areas outside of channel insert overlap without bolt-clip assembly interference with said inserts.

15. The mass seating equipment of claim 14, wherein said anchor means for each of said inserts comprises a pin element extended through both an elongate support plank channel wall and an end flange of said insert.

16. The mass seating equipment of claim 14, wherein said front and rear inserts are of substantially the same shape in transverse cross-section.

17. The mass seating equipment of claim 14, wherein said front and rear inserts are individually shaped to match front and rear channels of different shape in a contoured support plank extrusion mounted for seating.

18. The mass seating equipment of claim 14, wherein said end-to-end positioned support planks are formed with curves to match curvature of a stadium section where used; and said front and rear inserts are formed with curves to match the channels where used.

19. The mass seating equipment of claim 13, with said fastening means engaging said l-beam insert; said fastening means comprising a bolt member the shank of which is passed through the l-beam insert central web at a point intermediate said channel web lips.

20. The mass seating equipment of claim 19, with said l-beam insert central web being formed with elongated longitudinally extending through-slot means through which said bolt member shank extends in sliding confinement.

21. The mass seating equipment of claim 20, wherein said anchor means for each of said inserts comprises a pin element extended through both an elongate support plank channel wall and an end flange of said insert.

22. The mass seating equipment of claim 20, wherein said front and rear channel inserts are of substantially the same shape in transverse cross-section.

23. The mass seating equipment of claim 20, wherein said front and rear inserts are individually shaped to match front and rear channels of different shape in a contoured support plank extrusion mounted for seating.

24. The mass seating equipment of claim 20, wherein said end-to-end positioned support planks are formed with curves to match curvature of a stadium section where used; and said front and rear inserts are formed with curves to match the channels where used.

* * * * *